US011021915B2

(12) United States Patent
Foster et al.

(10) Patent No.: US 11,021,915 B2
(45) Date of Patent: Jun. 1, 2021

(54) SYSTEMS AND METHODS FOR REDUCING THE EFFECT OF BOREHOLE TORTUOSITY ON THE DEPLOYMENT OF A COMPLETION ASSEMBLY

(71) Applicant: Saudi Arabian Oil Company, Dhahran (SA)

(72) Inventors: Herschel Foster, Dhahran (SA); Mahmoud Alqurashi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 84 days.

(21) Appl. No.: 16/161,632

(22) Filed: Oct. 16, 2018

(65) Prior Publication Data

US 2020/0115967 A1 Apr. 16, 2020

(51) Int. Cl.

| | |
|---|---|
| ***E21B 17/20*** | (2006.01) |
| ***E21B 17/05*** | (2006.01) |
| ***E21B 7/06*** | (2006.01) |
| *E21B 7/04* | (2006.01) |

(52) U.S. Cl.

CPC ..... *E21B 17/05* (2013.01); *E21B 7/061* (2013.01); *E21B 17/20* (2013.01); *E21B 7/046* (2013.01)

(58) Field of Classification Search

CPC ..... E21B 17/20
USPC ..... 166/384
See application file for complete search history.

(56) References Cited

U.S. PATENT DOCUMENTS

| | | | |
|---|---|---|---|
| 4,143,722 A | 3/1979 | Driver | |
| 5,226,495 A | 7/1993 | Jennings, Jr. | |
| 5,415,227 A | 5/1995 | Jennings, Jr. | |
| 6,065,540 A | 5/2000 | Thomeer et al. | |
| 6,123,114 A * | 9/2000 | Seguin | F16L 11/083 138/124 |

(Continued)

FOREIGN PATENT DOCUMENTS

| | | |
|---|---|---|
| EP | 0911483 A2 | 4/1999 |
| EP | 1983153 A1 | 10/2008 |
| WO | 2018034662 A1 | 2/2018 |

OTHER PUBLICATIONS

Coflexip® Flexible Pipe (https://www.halliburton.eom/content/dam/ps/public/ts/contents/Data_Sheets/web/H/H012193-CoflexipPipe.pdf). 2016.*

(Continued)

*Primary Examiner* — Taras P Bemko
(74) *Attorney, Agent, or Firm* — Bracewell LLP; Constance G. Rhebergen; Linda L. Morgan

(57) ABSTRACT

A completion system for running in a directional wellbore includes a plurality of tubular members mechanically secured in-line to form a production tubular. One or more isolation packers are positioned in-line with the tubular members. A lower completion guide is located at a downhole end of the production tubular and a hanger assembly located at an uphole end of the production tubular. One or more of the tubular members includes a flexible pipe joint having: a base multilayered flexible tubular member; a first weave layer, the first weave layer being helically wrapped in a first direction around an outer diameter of the base multilayered flexible tubular member; a second weave layer, the second weave layer being helically wrapped in a second direction around an outer diameter of the first weave layer; and an outer tubular layer.

10 Claims, 2 Drawing Sheets

(56) References Cited

U.S. PATENT DOCUMENTS

| | | | | |
|---|---|---|---|---|
| 8,640,792 | B2 | 2/2014 | Underwood et al. | |
| 8,915,311 | B2 | 12/2014 | Belew et al. | |
| 9,605,482 | B2 | 3/2017 | Lange et al. | |
| 9,708,891 | B2 | 7/2017 | Mitchell et al. | |
| 2008/0283138 | A1* | 11/2008 | Rytter | F16L 11/083 138/133 |
| 2015/0136264 | A1* | 5/2015 | Holland | E21B 47/0006 138/104 |
| 2017/0130564 | A1* | 5/2017 | Steele | E21B 17/01 |
| 2017/0184243 | A1* | 6/2017 | Alberts | F16L 11/22 |
| 2018/0305989 | A1* | 10/2018 | Oyedokun | E21B 7/061 |

OTHER PUBLICATIONS

International Search Report and Written Opinion for related PCT application PCT/US2019/056255 dated Dec. 9, 2019.

"Cofexip Drilling & Service Applications User Guide", Coflexip Stena Offshore, 1996, pp. 58.

* cited by examiner

SYSTEMS AND METHODS FOR REDUCING THE EFFECT OF BOREHOLE TORTUOSITY ON THE DEPLOYMENT OF A COMPLETION ASSEMBLY

BACKGROUND OF THE DISCLOSURE

1. Field of the Disclosure

The present disclosure relates to subterranean developments, and more specifically, the disclosure relates to the deployment of completion assemblies within a subterranean well.

2. Description of the Related Art

In subterranean wells that are drilled to follow the structure of a subterranean formation, geo-steering can be used to maintain the trajectory of the wellbore within the zone where the fluids from the subterranean can be produced, known as the payzone. As a result of geo-steering, the wellbore can include a number of turns, curves, or doglegs, the cumulative effect of which can impede the successful subsequent running of the completion assembly. Completion assemblies being run through such a wellbore can become stuck or can be subject to sufficient bending or torsional stresses that the completion assembly becomes damaged or destroyed.

SUMMARY OF THE DISCLOSURE

Systems and methods of this disclosure can facilitate the running of the lower completion assemblies in deviated wells, horizontal wells, or wells with a number of doglegs. Embodiments of this disclosure are particularly well suited for subterranean wells that include an openhole screen based completion system. Screens generally cannot be rotated or significantly bent while being deployed and in reservoir sections where there has been geosteering there may be significant tortuosity in the well path. Embodiment of this disclosure can provide the balance between strength and flexibility which is required for the screens to pass by dogleg sections. Systems and method of this disclosure can alternately be utilized with any lower completion tubing based system that will be deployed in a well with a challenging well profile. The solution is not limited to screens only it will apply for conventional tubing and casing too Systems and method described in this disclosure provide a flexible pipe joint that can reduce the overall impact of wellbore tortuosity due to the geo-steering of horizontal wellbores across production zones. The flexible pipe joint has sufficient flexibility to bend around a curve of the direction of the wellbore, yet strong enough to sufficiently withstand the forces of buckling while being run into the wellbore. The flexible pipe joint is sufficiently durable to last for the life of the well. Multiple flexible pipe joints can be placed in the completion assembly and optimally positioned within the completion assembly based on an engineering model or final post drilling survey.

In an embodiment of this disclosure, a completion system for running in a directional wellbore includes a plurality of tubular members mechanically secured in-line to form a production tubular. One or more isolation packers are positioned in-line with the tubular members. A lower completion guide is located at a downhole end of the production tubular. A hanger assembly is located at an uphole end of the production tubular. One or more of the tubular members includes a flexible pipe joint, the flexible pipe joint having: a base multilayered flexible tubular member; a first weave layer, the first weave layer being helically wrapped in a first direction around an outer diameter of the base multilayered flexible tubular member; a second weave layer, the second weave layer being helically wrapped in a second direction around an outer diameter of the first weave layer; and an outer tubular layer.

In alternate embodiments of this disclosure, the base multilayered flexible tubular member can include an inner liner member and a reinforcing member circumscribing the inner liner member. The completion system can include at least two of the flexible pipe joints. Each of the tubular members located between adjacent of the at least two of the flexible pipe joints can have a production screen. The first weave layer and the second weave layer can be formed of steel.

In an alternate embodiment of this disclosure, a completion system for running in a directional wellbore includes a plurality of tubular members mechanically secured in-line to form a production tubular, the production tubular positioned within the directional wellbore. One or more isolation packers is positioned in-line with the tubular members, the one or more isolation packers operable to form a seal with an inner diameter surface of the directional wellbore. A hanger assembly is located at an uphole end of the production tubular, the hanger assembly operable to support the production tubular within a casing. One or more of the tubular members includes a flexible pipe joint, the flexible pipe joint having: a base multilayered flexible tubular member; a first weave layer, the first weave layer being helically wrapped in a first direction around an outer diameter of the base multilayered flexible tubular member; a second weave layer, the second weave layer being helically wrapped in a second direction around an outer diameter of the first weave layer; and an outer tubular layer. The one or more of the tubular members are positioned along the production tubular at predetermined locations of maximum bending stress of the production tubular during the running in of the completion system in the directional wellbore.

In alternate embodiments, the base multilayered flexible tubular member can include an inner liner member and a reinforcing member circumscribing the inner liner member. The completion system can include at least two of the flexible pipe joints and each of the tubular members located between adjacent of the at least two of the flexible pipe joints can have a production screen. The first weave layer and the second weave layer can be formed of steel.

In another alternate embodiment of this disclosure, a method for running a completion system into a directional wellbore includes securing a plurality of tubular members mechanically in-line to form a production tubular and positioning one or more isolation packers in-line with the tubular members. A lower completion guide is provided at a downhole end of the production tubular. A hanger assembly is provided at an uphole end of the production tubular. One or more of the tubular members includes a flexible pipe joint, the flexible pipe joint having: a base multilayered flexible tubular member; a first weave layer, the first weave layer being helically wrapped in a first direction around an outer diameter of the base multilayered flexible tubular member; a second weave layer, the second weave layer being helically wrapped in a second direction around an outer diameter of the first weave layer; and an outer tubular layer.

In alternate embodiments, the base multilayered flexible tubular member includes an inner liner member and a reinforcing member circumscribing the inner liner member.

The flexible pipe joint can be positioned along the production tubular at predetermined locations of maximum bending stress of the production tubular during the running in of the completion system in the directional wellbore. The directional wellbore can include a bend in a range of twelve to fifteen degrees.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
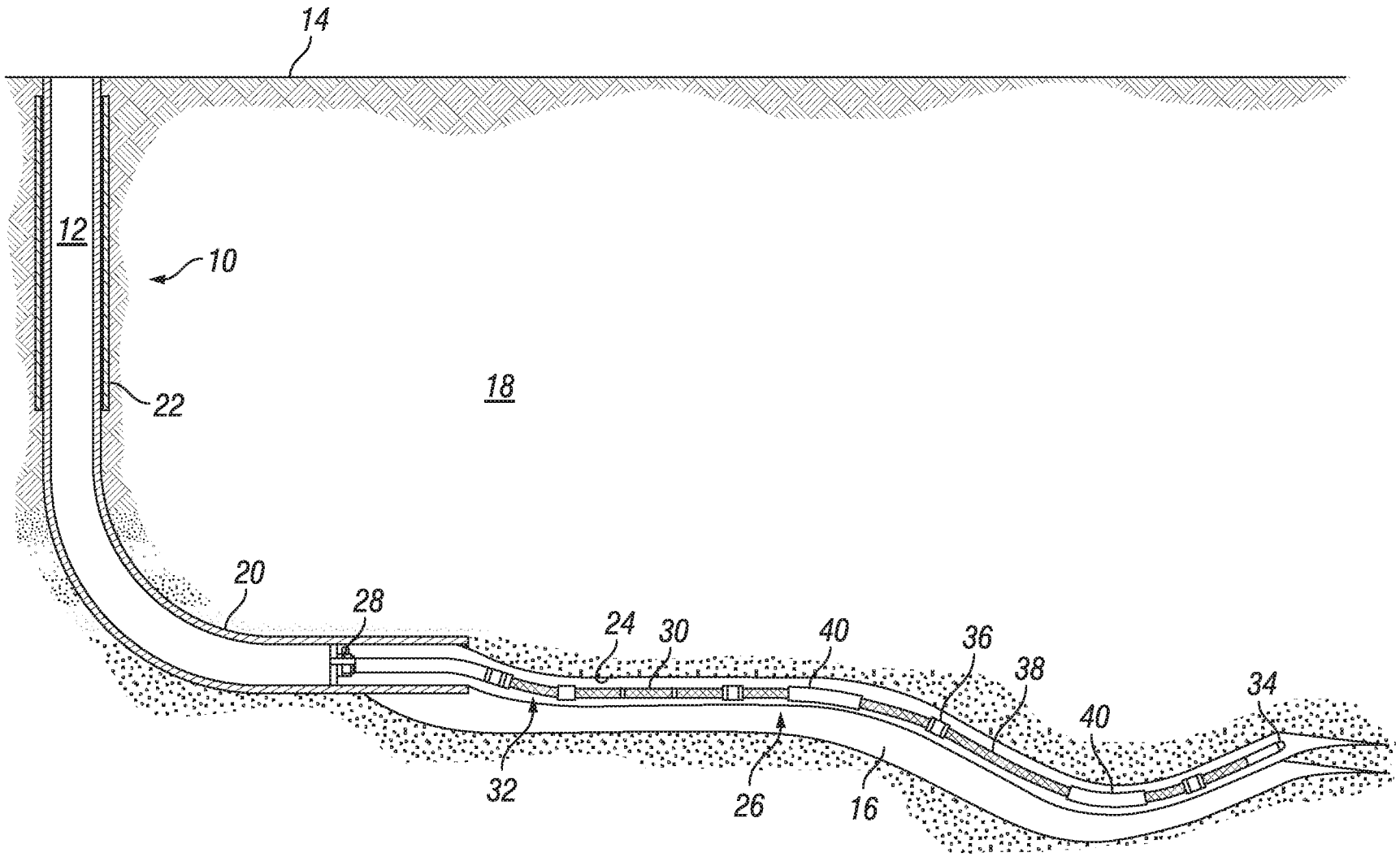
FIG. 1 is a section view of a subterranean well with a completion assembly in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Wellbore 12 can be drilled from surface 14 and into reservoir 16. Reservoir 16 can be a layered reservoir that follows an irregular or meandering path. Geo-steering can be used to direct the drilling of wellbore 12 so that wellbore 12 passes through various layered formations and follows the path of reservoir 16.

A portion of the length of wellbore 12 can be lined with inner casing 20 and outer casing 22. Another portion of the length of wellbore 12 can be an uncased or open hole region 24 of wellbore 12. Completion system 26 can extend from inner casing 20 and into open hole region 24 of wellbore 12.

Completion system 26 can be a lower completion system that is set adjacent to reservoir 16. Completion system 26 can be anchored to inner casing 20 with hanger assembly 28. Hanger assembly 28 is located at an uphole end of completion system 26 and supports completion system 26 within inner casing 20 in a known manner.

Completion system 26 includes a plurality of tubular members 30 mechanically secured in-line to form production tubular 32. Production tubular can have a diameter for example, in a range of 2 and ⅞ inches to 18 and ⅝ inches. Production tubular 32 extends from hanger assembly 28 to lower completion guide 34 so that hanger assembly 28 is located at an uphole end of production tubular 32 and lower completion guide 34 is located at a downhole end of production tubular 32. Lower completion guide 34 can be threaded or otherwise connected to the downhole end of production tubular 32 and can have a rounded end profile to assist in guiding completion system 26 into and through wellbore 12.

Completion system 26 can also include one or more isolation packers 36 positioned in-line with tubular members 30. Isolation packer 36 can be in a deflated state while running completion system 26 and can be inflated or expanded when completion system 26 has landed in order to form a seal with an inner diameter surface of wellbore 12. Isolation packer 36 can be used to prevent fluids in one region of wellbore 12 from traveling past isolation packer 36 to another region of wellbore 12.

Tubular member 30 can also include production screens 38. Production screens 38 can control the amount of sand entering completion system 26 while allowing production fluids from reservoir 16 to enter completion system 26. Maximizing the number of production screens 38 can maximize the productivity of subterranean well 10. By reducing a stiffness of completion system 26 with flexible pipe joint 40, production screens 38 can be deployed in increasingly tortuous well profiles, such as those resulting from geo-steering.

One or more of tubular members 30 can be flexible pipe joint 40 that is secured in-line with adjacent tubular members 30. As an example, flexible pipe joint 40 can be threaded or otherwise connected to adjacent tubular members 30.

Figure 2:
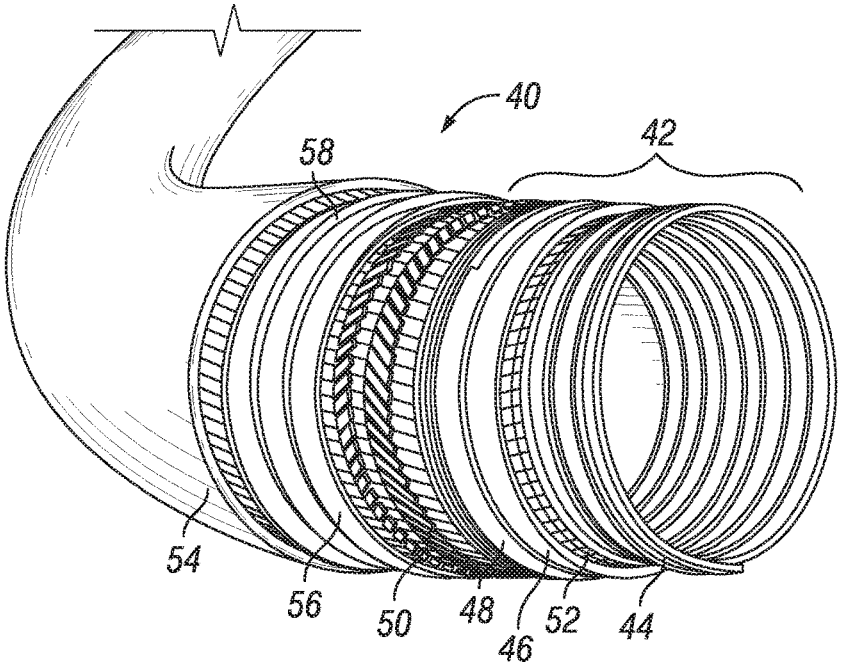
FIG. 2 is a schematic diagram of an assembled flexible pipe joint in accordance with an embodiment of this disclosure.

Looking at FIG. 2, in an example embodiment flexible pipe joint 40 can include base tubular member 42. Base tubular member 42 can be a base multilayered flexible tubular member and include inner liner member 44. Inner liner member 44 can define an inner diameter bore of flexible pipe joint 40. Base tubular member 42 and inner liner member 44 can be formed of, for example, steel such as steel used to form oil country tubular goods. Alternately, base tubular member 42 and inner liner member 44 can be formed of an austenitic nickel-chromium-based super alloy, such as Inconel® (a registered mark of Special Metals Corporation).

One or more reinforcing members can circumscribe base tubular member 42. As an example, reinforcing members can include one of, or a combination of, pressure sheath 46, pressure vault 48, and armor layer 50. In the embodiment of FIG. 2, two separate armor layers 50 are included. One or more intermediate sheath or tensile layers 52 can be located adjacent to reinforcing members.

Flexible pipe joint 40 can further include external sheath 54 as an outer tubular layer. External sheath 54 is an outermost member of flexible pipe joint 40 and defines an outer diameter surface of flexible pipe joint 40. External sheath 54 can be made from a light, highly flexible and high strength alloy, alone or in combination.

Flexible pipe joint 40 further includes first weave layer 56 and second weave layer 58. First weave layer 56 is helically wrapped in a first direction around an outer diameter of base tubular member 42 and second weave layer 58 is helically wrapped in a second direction around base tubular member 42. First weave layer 56 and second weave layer 58 can be formed of, for example, steel such as steel used to form oil country tubular goods. In alternate embodiments, first weave layer 56 and second weave layer 58 can be formed of a nickel-chromium-based super alloy such as Inconel® (a registered mark of Special Metals Corporation), or an iron based superalloy. In other alternate embodiments first weave layer 56 and second weave layer 58, can be formed of other materials that exhibit high strength and ductility, mechanical strength, resistance to thermal creep deformation, good surface stability, and resistance to corrosion or oxidation.

The flexibility of the combination of first weave layer 56 and second weave layer 58 is not derived from the material used to form first weave layer 56 and second weave layer 58, but from the helical and oppositely directed weave of first weave layer 56 and second weave layer 58. Additional yield strength can be provided by including tensile layer 52 between first weave layer 56 and second weave layer 58. When the flexible pipe joint 40 is loaded in axial tension, a compressive strain can be generated in first weave layer 56 and second weave layer 58, resulting in an inward radial displacement. When flexible pipe joint 40 is loaded with pressure, the squeezing or ballooning of flexible pipe joint 40 can produce a corresponding change of axial length of flexible pipe joint 40. Flexible pipe joint 40 should exhibit elastic stress-strain behavior. With elastic stress-strain behavior the stress and strain are linearly related by a constant of proportionality. When flexible pipe joint 40 is loaded elastically and then unloaded, flexible pipe joint 40 will return to the original dimensions of flexible pipe joint 40 and there will be no permanent, residual stress or strain left over in flexible pipe joint 40.

First weave layer 56 and second weave layer 58 provide anti-buckling features to flexible pipe joint 40. Because first weave layer 56 and second weave layer 58 are wound in opposite directions, any bending and buckling forces counter each other with the combination of first weave layer 56 and second weave layer 58, providing a range of movement which is defined by the density of the wraps per linear foot of first weave layer 56 and second weave layer 58. Therefore the combination of first weave layer 56 and second weave layer 58 will prevent excessive torsion and bending that could otherwise damage or destroy flexible pipe joint 40. However, flexible pipe joint 40 will retain sufficient flexibility to be run into wellbore 12, which can include changes in direction of up to fifteen degrees and will maintain sufficient strength to withstand the forces required to run completion system 26 into wellbore 12.

Using software simulation, it was shown that including first weave layer 56 and second weave layer 58 in flexible pipe joint 40 can provide a 50% increase in the torsion flexibility of pipe joint 40, and a 50% reduction in side forces undergone by flexible pipe joint 40 compared to a joint that does not include first weave layer 56 and second weave layer 58 but is otherwise similar. The range and magnitude of side forces that a typical completion system can undergo will be dependent on the tortuosity of the wellbore and will vary from well to well depending on the well profile that was drilled.

Figure 3A:
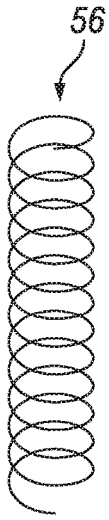
FIGS. 3A-3E are a schematic diagram of the separate layers of a flexible pipe joint in accordance with an embodiment of this disclosure.
Figure 3B:
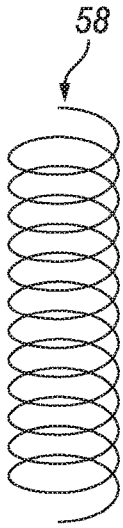
Figure 3C:
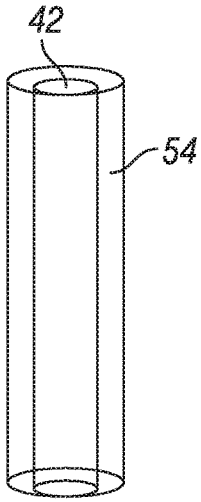
Figure 3D:
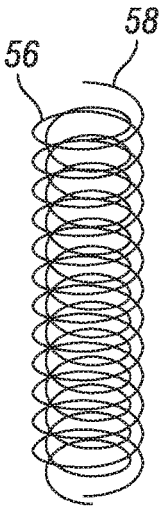
Figure 3E:
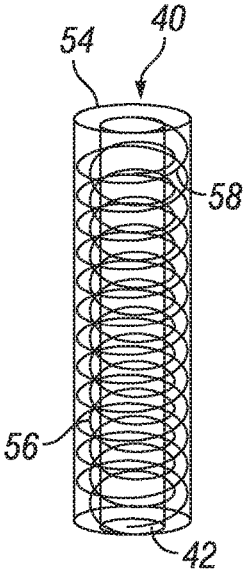

Looking at FIGS. 3A-3E, in order to form flexible pipe joint 40, first weave layer 56 (FIG. 3A) and second weave layer 58 (FIG. 3B) can be separately formed. First weave layer 56 and second weave layer 58 are self-supporting in that first weave layer 56 and second weave layer 58 can retain a helical shape without external support, while the pressure integrity and tensile strength are provided by other layers of flexible pipe joint 40. Base tubular member 42 and external sheath 54 can be provided separate from first weave layer 56 and second weave layer 58 (FIG. 3C). First weave layer 56 and second weave layer 58 can then be combined together (FIG. 3D). The combined first weave layer 56 and second weave layer 58 can then be positioned radially outward of base tubular member 42 and radially inward of external sheath 54 to form flexible pipe joint 40 (FIG. 3E).

In an example of operation, wellbore 12 can be drilled using known geo-steering techniques to follow a desired path. After drilling operations are complete, an engineering model or final survey of wellbore 12 and completion system 26 can be used to determine the arrangement of the components of completion system 26. In certain embodiments there can be at least two flexible pipe joints 40. In order to maximize the amount of amount of production screens 38, each tubular member 30 located between adjacent of the at least two of the flexible pipe joints 40 has a production screen 38.

The number and position of flexible pipe joints 40 can be determined by such engineering model or final survey. As an example, flexible pipe joints 40 can be located along completion system 26 at locations where the highest anticipated bending stresses are anticipated during the running of completion system 26 into wellbore 12, such as at the locations of bends of wellbore 12 of twelve to fifteen degrees. After running completion system 26 into wellbore 12, the isolation packers 36 can be inflated or expanded when completion system 26 has landed in order to form a seal with an inner diameter surface of wellbore 12 and hydrocarbons or other fluids from reservoir 16 can enter completion string 26 through production screen 38 for delivery to the surface.

Embodiments described in this disclosure therefore provide systems and methods that include a flexible pipe joint that is both flexible, can resist sinusoidal and helical buckling, and can safely transmit the compressive forces applied during the running of the completion system into the wellbore. Such a flexible joint can allow for a wellbore to be drilled using geo-steering technology to follow an optimal path along and through a reservoir and therefore allow more exposure of the wellbore to the payzone, with reduced concerns for such a path leading to sticking, damage, or destruction of the completion assembly.

Systems and methods of this disclosure therefore allow operators to provide a wellbore that maximizes reservoir contact to maximize production from the reservoir. In addition, embodiments of this disclosure allow for an increase in the number of production screens that can be made part of the completion assembly, compared to currently available systems.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A completion system for running in a directional wellbore, the completion system including:

a plurality of tubular members mechanically secured in-line to form a production tubular;

one or more isolation packers positioned in-line with the tubular members;

a lower completion guide threaded in-line with the tubular members at a terminal downhole end of the production tubular; and a hanger assembly located at an uphole end of the production tubular; where at least two of the tubular members includes a production screen;

one or more of the tubular members includes a flexible pipe joint, the flexible pipe joint having:

a base multilayered flexible tubular member;

a first weave layer, the first weave layer being helically wrapped in a first direction around an outer diameter of the base multilayered flexible tubular member;

a second weave layer, the second weave layer being helically wrapped in a second direction around an outer diameter of the first weave layer; and an outer tubular layer; where the completion system is a lower completion system located within an open hole region of the wellbore having a tortuous well profile;

the isolation packer is threaded in-line between adjacent production screens;

the isolation packer engages an inner diameter of the open hole region of the wellbore;

the flexible pipe joint is threaded in-line between adjacent production screens; and where the completion system is a permanent production system located within the directional wellbore during hydrocarbon production operations.

2. The completion system of claim 1 where the base multilayered flexible tubular member includes an inner liner member and a reinforcing member circumscribing the inner liner member.

3. The completion system of claim 1, where the first weave layer and the second weave layer are formed of steel.

4. A completion system for running in a directional wellbore, the completion system including:

a plurality of tubular members mechanically secured in-line to form a production tubular, the production tubular positioned within the directional wellbore;

one or more isolation packers positioned in-line with the tubular members, the one or more isolation packers operable to form a seal with an inner diameter surface of the directional wellbore;

a lower completion guide threaded in-line with the tubular members at a terminal downhole end of the production tubular;

a hanger assembly located at an uphole end of the production tubular, the hanger assembly operable to support the production tubular within a casing;

at least two of the tubular members includes a production screen; where one or more of the tubular members includes a flexible pipe joint, the flexible pipe joint having:

a base multilayered flexible tubular member;

a first weave layer, the first weave layer being helically wrapped in a first direction around an outer diameter of the base multilayered flexible tubular member;

a second weave layer, the second weave layer being helically wrapped in a second direction around an outer diameter of the first weave layer; and an outer tubular layer; where the flexible pipe joint is positioned along the production tubular at a predetermined location of maximum bending stress of the production tubular during the running in of the completion system in the directional wellbore;

the completion system is a lower completion system located within an open hole region of the wellbore having a tortuous well profile;

the isolation packer is threaded in-line between adjacent production screens;

the isolation packer engages an inner diameter of the open hole region of the wellbore;

the flexible pipe joint is threaded in-line between adjacent production screens; and where the completion system is a permanent production system located within the directional wellbore during hydrocarbon production operations.

5. The completion system of claim 4 where the base multilayered flexible tubular member includes an inner liner member and a reinforcing member circumscribing the inner liner member.

6. The completion system of claim 4, where the first weave layer and the second weave layer are formed of steel.

7. A method for running a completion system into a directional wellbore, the method including:

securing a plurality of tubular members mechanically in-line to form a production tubular;

positioning one or more isolation packers in-line with the tubular members;

threading a lower completion guide to a terminal downhole end of the production tubular; and providing a hanger assembly at an uphole end of the production tubular; where at least two of the tubular members includes a production screen;

one or more of the tubular members includes a flexible pipe joint, the flexible pipe joint having:

a base multilayered flexible tubular member;

a first weave layer, the first weave layer being helically wrapped in a first direction around an outer diameter of the base multilayered flexible tubular member;

a second weave layer, the second weave layer being helically wrapped in a second direction around an outer diameter of the first weave layer; and an outer tubular layer;

the completion system is a lower completion system located within an open hole region of the wellbore having a tortuous well profile;

the isolation packer is threaded in-line between adjacent production screens;

the isolation packer engages an inner diameter of the open hole region of the wellbore;

the flexible pipe joint is threaded in-line between adjacent production screens; and where the completion system is a permanent production system located within the directional wellbore during hydrocarbon production operations.

8. The method of claim 7 where the base multilayered flexible tubular member includes an inner liner member and a reinforcing member circumscribing the inner liner member.

9. The method of claim 7, further including positioning the flexible pipe joint along the production tubular at predetermined locations of maximum bending stress of the production tubular during the running in of the completion system in the directional wellbore.

10. The method of claim 7, where the directional wellbore includes a bend in a range of twelve to fifteen degrees.

* * * * *